US007545331B2

(12) United States Patent
Jeon et al.

(10) Patent No.: US 7,545,331 B2
(45) Date of Patent: Jun. 9, 2009

(54) ANTENNA DEVICE FOR PORTABLE TERMINAL

(75) Inventors: Hyu-Myung Jeon, Seongnam-si (KR); Dae-Chul Kang, Suwon-si (KR); Yong-Jin Kim, Seoul (KR); Yu-Jin Chung, Suwon-si (KR); Tae-Hui Cho, Gunpo-si (KR)

(73) Assignee: Samsung Electronics Co., Ltd (KR)

( * ) Notice: Subject to any disclaimer, the term of this patent is extended or adjusted under 35 U.S.C. 154(b) by 192 days.

(21) Appl. No.: 11/482,409

(22) Filed: Jul. 7, 2006

(65) Prior Publication Data

US 2007/0080874 A1 Apr. 12, 2007

(30) Foreign Application Priority Data

Sep. 23, 2005 (KR) ..... 10-2005-0088788

(51) Int. Cl.
*H01Q 1/24* (2006.01)
*H01Q 1/10* (2006.01)
*H01Q 1/36* (2006.01)

(52) U.S. Cl. ..... 343/702; 343/889; 343/895

(58) Field of Classification Search ..... 343/702, 343/889, 895, 900, 793, 797, 810–820, 846
See application file for complete search history.

(56) References Cited

U.S. PATENT DOCUMENTS

| | | | | |
|---|---|---|---|---|
| 5,861,859 | A * | 1/1999 | Kanayama et al. | 343/895 |
| 6,369,764 | B1 * | 4/2002 | Ishikawa | 343/702 |
| 6,756,943 | B2 * | 6/2004 | Kim et al. | 343/702 |
| 7,061,433 | B2 * | 6/2006 | Kim et al. | 343/702 |

FOREIGN PATENT DOCUMENTS

| | | |
|---|---|---|
| JP | 11-243310 | 9/1999 |

* cited by examiner

*Primary Examiner*—Shih-Chao Chen
(74) *Attorney, Agent, or Firm*—The Farrell Law Firm, PC

(57) ABSTRACT

An antenna device for a portable terminal, which allows a whip antenna and helical antenna of a terminal to be retracted and withdrawn along an extension from the terminal, while not causing them to protrude out of the terminal. The antenna device provided with a whip antenna and helical antenna further includes an antenna housing disposed at a desired position in the main body, which permits the whip antenna to be retracted and withdrawn through the helical antenna, while causing the helical antenna to be withdrawn along an extension from the main body at the same time, and permits the helical antenna to be retracted, so that it can be inserted into the main body; and a housing coupling portion disposed in the main body for supporting the antenna housing.

10 Claims, 8 Drawing Sheets

ANTENNA DEVICE FOR PORTABLE TERMINAL

PRIORITY

This application claims priority under 35 U.S.C. § 119 to an application entitled "ANTENNA DEVICE FOR PORTABLE TERMINAL" filed in the Korean Industrial Property Office on Sep. 23, 2005 and assigned Serial No. 2005-88788, the contents of which are incorporated herein by reference.

BACKGROUND OF THE INVENTION

1. Field of the Invention

The present invention relates to an antenna device for a portable terminal. Particularly, the present invention relates to an antenna device for a portable terminal, which allows a whip antenna and helical antenna of a terminal to be retracted/withdrawn along an extension from the terminal, while not requiring the antennas to protrude out of the terminal.

2. Description of the Related Art

Recently, portable terminals have been made to be multi-functional and downsized due to consumer demands. Particularly, such multi-functional terminals provide voice communication service, radio service, and MP3 music download service via Internet. Additionally, it is possible to obtain digital information about various data and images with ease from portable terminals, Personal Digital Assistants (PDAs), computers and notebook computers.

The portable terminals generally include a liquid crystal display (LCD) as a data output device. Conventionally, a keypad including a plurality of keys is used for the input of data.

In addition to the above, a portable terminal has an antenna device positioned in a suitable location in its main body for receiving signals transmitted from a counterpart terminal.

Antenna devices currently used for portable terminals may be classified as external antennas which protrude from the housing and internal antennas disposed inside the housing of a terminal. More particularly, external antennas include whip antennas and helical antennas. Internal antennas include inverted L antennas, planar inverted F antennas, diversity antennas and microstrip antennas.

Portable terminals with the above-described structure have spread quickly to consumers and are used widely. Also, there is a tendency to develop multi-functional portable terminals having various functions for satisfying the various needs of consumers in addition to simple communication service. For example, besides voice communication, additional services for users include video-on-demand (VOD) service, image communication service, digital camera function, Internet service, TV service, etc.

A portable terminal capable of TV service among the above additional services is referred to as a digital multimedia-broadcasting (DMB) terminal. A DMB terminal allows a user to watch TV programs through a display device, while also performing a mobile telecommunication function.

The portable terminal capable of TV service includes at least two Radio Frequency (RF) modules, because a frequency band necessary for transception of voice and data is different than a frequency band for TV broadcasting. The portable terminal capable of TV service is operated in a phone mode, waiting mode, and a broadcasting service mode, which is an image reception mode combined with a waiting mode.

Antennas for TV broadcasting signals include a helical antenna for exclusive use in a broadcasting service, which is mounted to a terminal, and an external antenna for exclusive use of broadcasting service. Regarding antenna devices for exclusive use in the broadcasting service, a retractable antenna having a whip antenna combined with a helical antenna is used widely.

As shown in FIG. 1, the helical antenna 2 is disposed at a suitable position in a portable terminal in order to receive signals transmitted from a counterpart sender.

The helical antenna 2 protrudes from the main body 1 of the terminal by a predetermined length in such a manner that the whip antenna 3 is retracted/withdrawn through it. Therefore, there are disadvantages in that the helical antenna 2 may be broken due to the retraction/withdrawal of the whip antenna 3. It is also inconvenient to carry the terminal 1 in a bag, pocket, etc. due to the helical antenna 2 protruding out of the terminal. Additionally, such a protruding portion may be damaged and broken if a user drops the terminal, and such an antenna makes it impossible to obtain an attractive design for the terminal.

As shown in FIG. 2, the antenna 4 for TV broadcasting signals includes a broadcasting signal-receiving module (not shown) embedded therein. The terminal 1 is equipped with an interface connector (not shown) for connecting the broadcasting signal receiving module with the external antenna for exclusive use in the broadcasting service. Additionally, a jack 4*a* of the external antenna 4 for exclusive use in the broadcasting service is connected with the interface connector (not shown), so as to receive TV broadcasting signals.

The multi-functional portable terminal as described above should have an antenna for general voice transception. Additionally, an antenna for exclusive use in the broadcasting service and designed for frequencies in radio and TV broadcasting service is mounted to the terminal, wherein the antenna for exclusive use in the broadcasting service is essential for satisfactory reception of broadcasting signals.

However, a conventional antenna for exclusive use in the broadcasting service is inconvenient to use, because it is too bulky when fixed to a terminal to permit the enjoyment of radio and TV services. Additionally, users must carry the antenna at all times even when it is not used, resulting in poor portability.

Further, it is necessary for users to carry a conventional antenna for exclusive use in the broadcasting service at all times in order to use it on demand. Therefore, there exists a great possibility of the losing of the antenna. Moreover, when a separate casing is provided in order to prevent the loss of antenna, an additional cost arises.

SUMMARY OF THE INVENTION

Accordingly, the present invention has been made to solve the above-mentioned problems occurring in the prior art. An object of the present invention is to provide an antenna device for a portable terminal, which allows a whip antenna and helical antenna of a terminal to be retracted/withdrawn along an extension from the terminal, while not causing them to protrude from the terminal, such that an attractive design of the terminal can be obtained and the antenna can be prevented from being damaged by external impacts.

Another object of the present invention is to provide an antenna device for a portable terminal, which is retracted/withdrawn along an extension from a terminal, so that an antenna for exclusive use in the broadcasting service can have improved portability.

In order to accomplish the above objects, there is provided an antenna device for a portable terminal, which includes: a whip antenna provided in a main body of the terminal; a helical antenna through which the whip antenna passes; and an antenna housing disposed at a suitable position in the main body, which causes the whip antenna to be retracted/withdrawn, while causing the helical antenna to be withdrawn along an extension from the main body at the same time, and permits the helical antenna to be retracted, so that it can be inserted into the main body.

BRIEF DESCRIPTION OF THE DRAWINGS

The above and other objects, features and advantages of the present invention will be more apparent from the following detailed description taken in conjunction with the accompanying drawings, in which.

DETAILED DESCRIPTION OF THE PREFERRED EMBODIMENT

Hereinafter, preferred embodiments of the present invention will be described with reference to the accompanying drawings.

Figure 1:
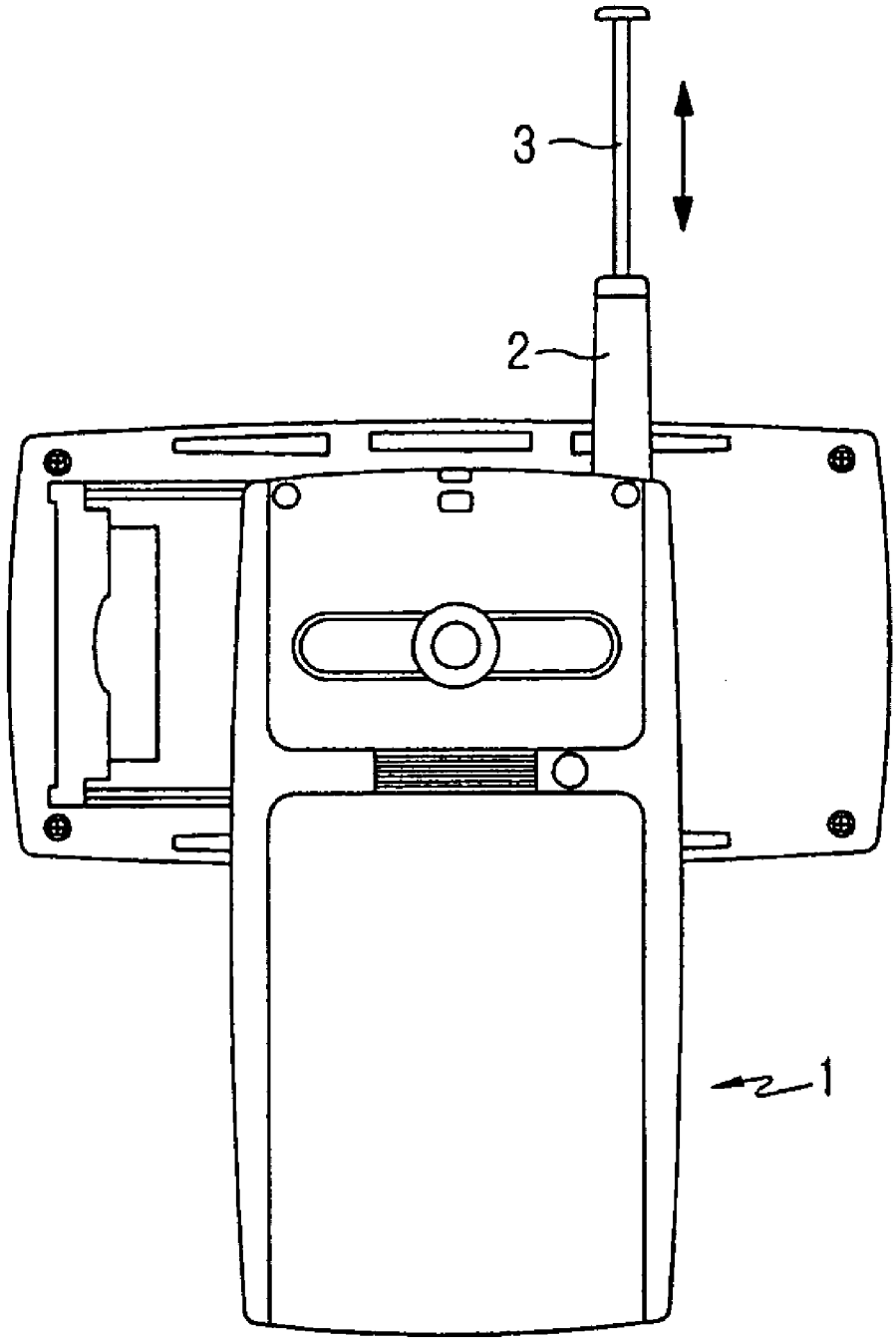
FIG. 1 (PRIOR ART)
FIG. 1 is a portable terminal having a whip antenna and helical antenna according to the prior art.
Figure 2:
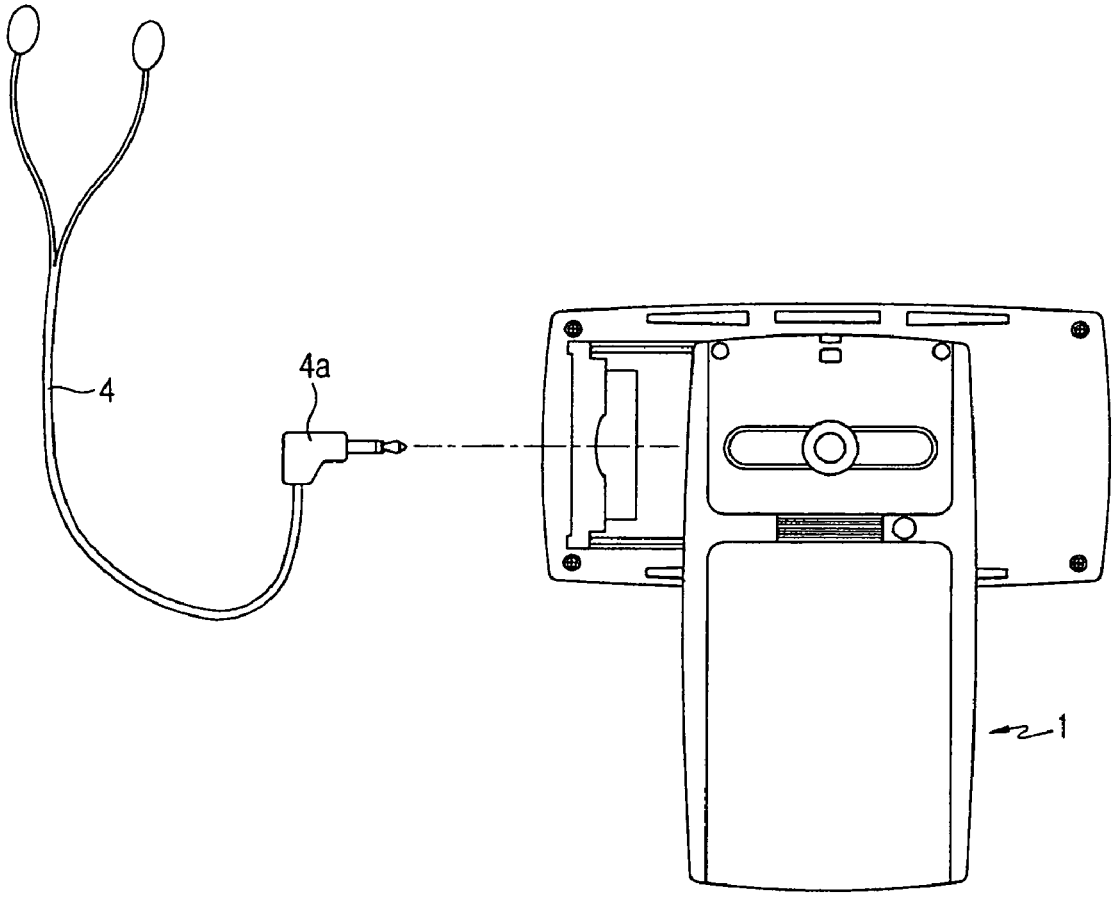
FIG.2 (PRIOR ART)
FIG. 2 is a schematic view showing how to connect an antenna device for a portable terminal according to the prior art with a terminal.
Figure 3:
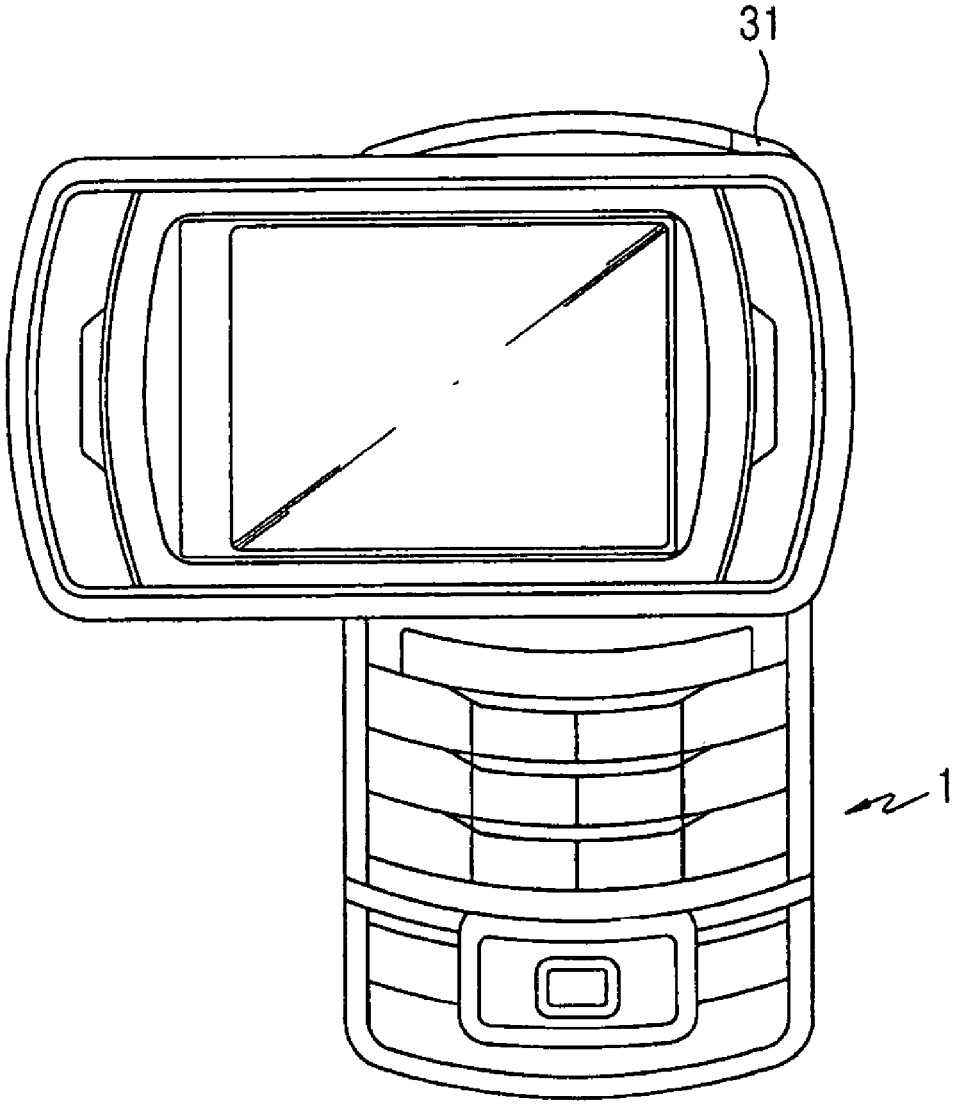
FIG. 3 is a front view showing an antenna device for a portable terminal according to a preferred embodiment of the present invention, before operation thereof.
Figure 4:
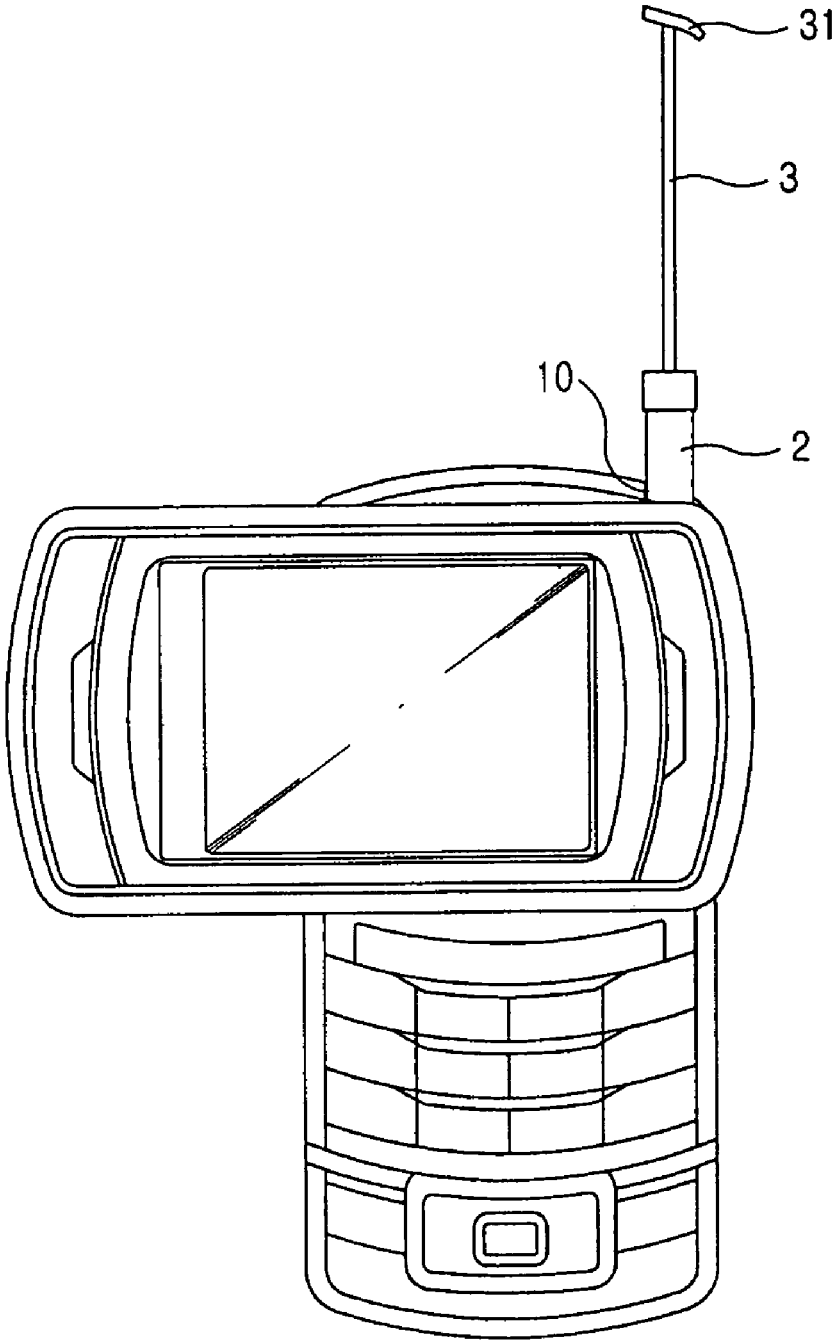
FIG. 4 is a front view showing an antenna device for a portable terminal according to a preferred embodiment of the present invention, after operation thereof.
Figure 5:
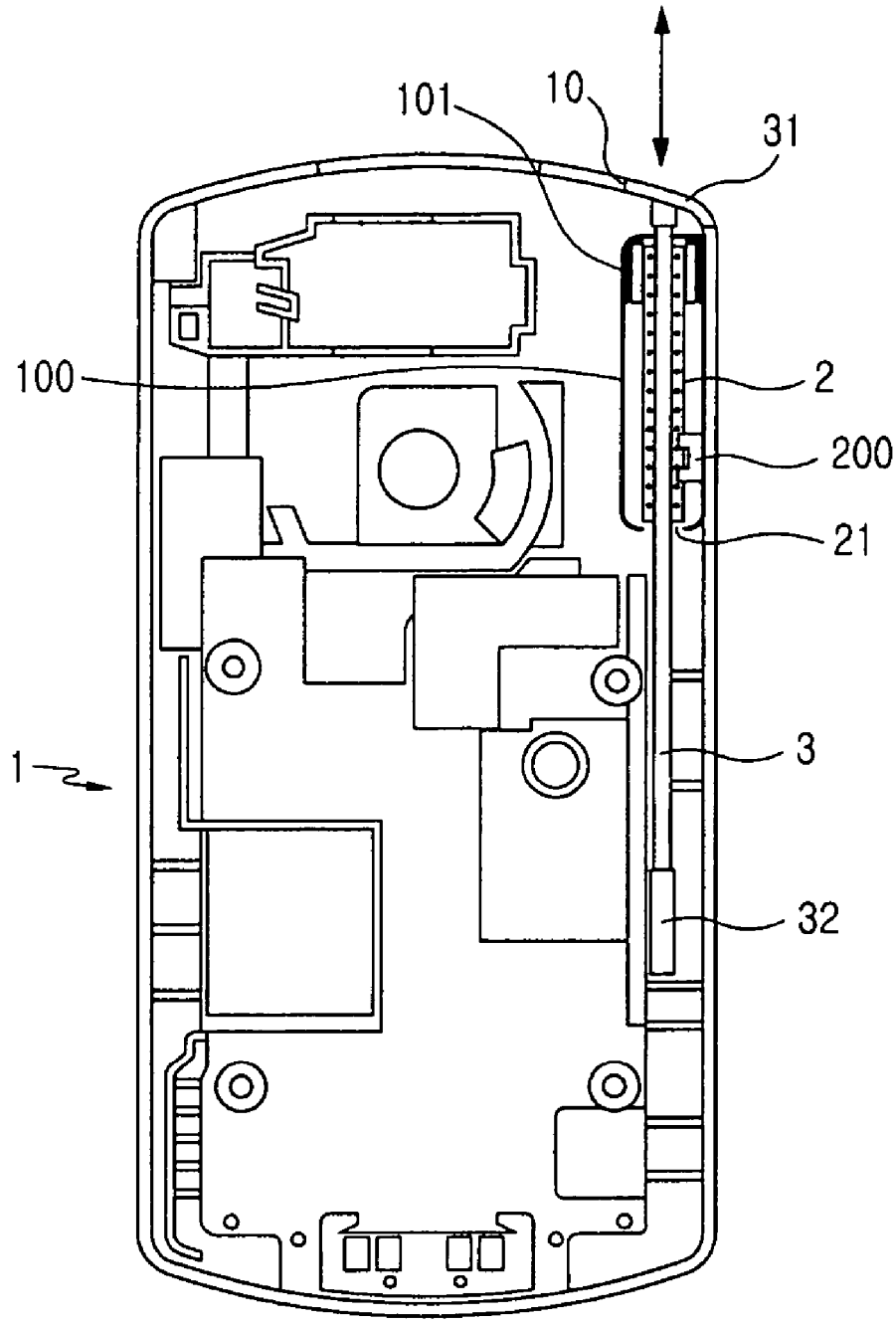
FIG. 5 is an inside view showing an antenna device for a portable terminal according to a preferred embodiment of the present invention, after it is mounted to a terminal.

As shown in FIGS. 3, 4 and 5, an antenna device for a portable terminal includes a whip antenna 3, helical antenna 2, antenna housing 100 and a housing coupling portion 200. The whip antenna 3 and helical antenna 2 are for exclusive use in the broadcasting service. The antenna housing 100 is disposed in a suitable portion of the main body 1 of a terminal in such a manner that it causes the whip antenna 3 to be retracted/withdrawn through the helical antenna 2, while causing the helical antenna 2 to be withdrawn along an extension from the main body 1 of a terminal at the same time, and permits the helical antenna 2 to be retracted, so as to be inserted into the main body 1. The housing coupling portion 200 is disposed adjacent to the antenna housing 100, so that it fixes the antenna housing 100 to the main body 1 and supports the antennas 2 and 3 in order to allow their retraction/withdrawal.

Figure 6:
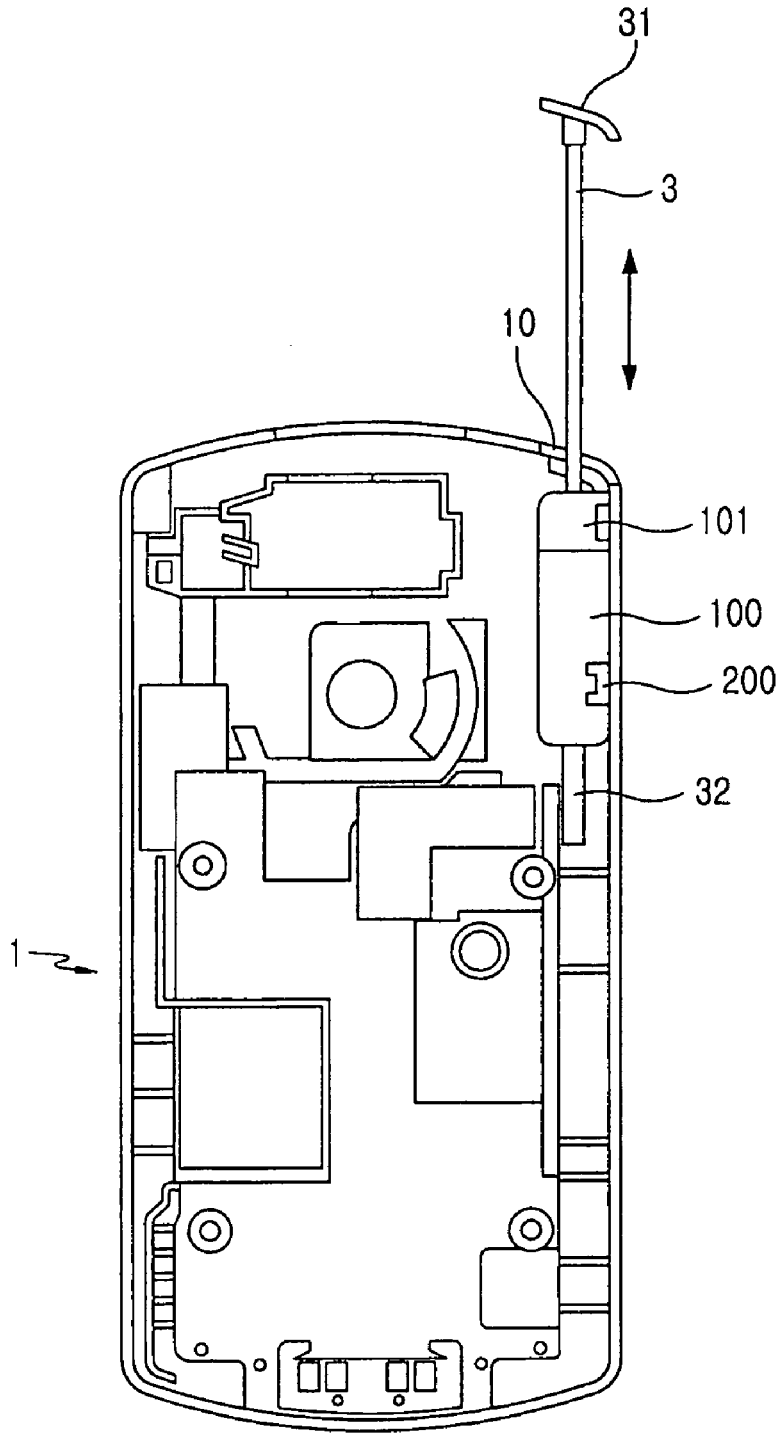
FIG. 6 is an inside view showing how to operate an antenna device for a portable terminal according to a preferred embodiment of the present invention, after it is mounted to a terminal.
Figure 7:
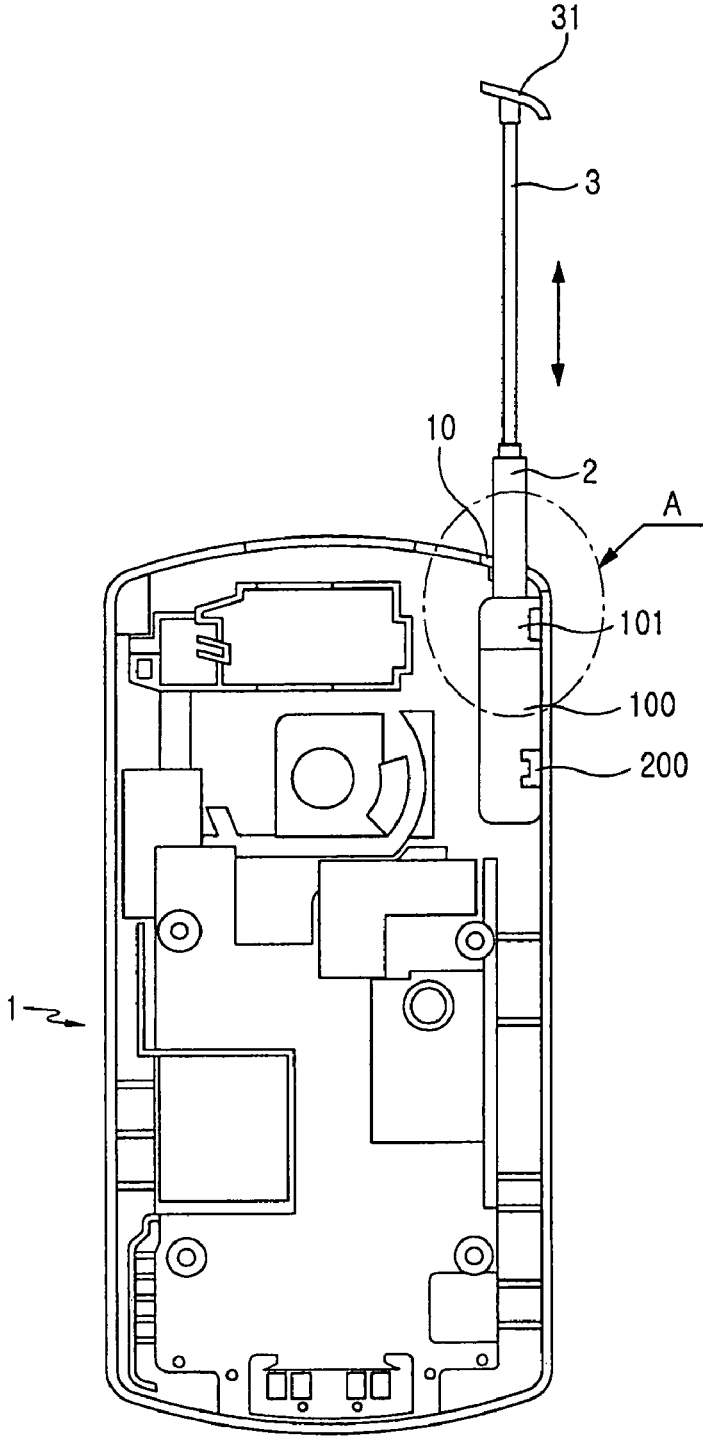
FIG. 7 is an inside view showing an antenna device for a portable terminal according to a preferred embodiment of the present invention, which is mounted to a terminal, after operation thereof.
Figure 8:
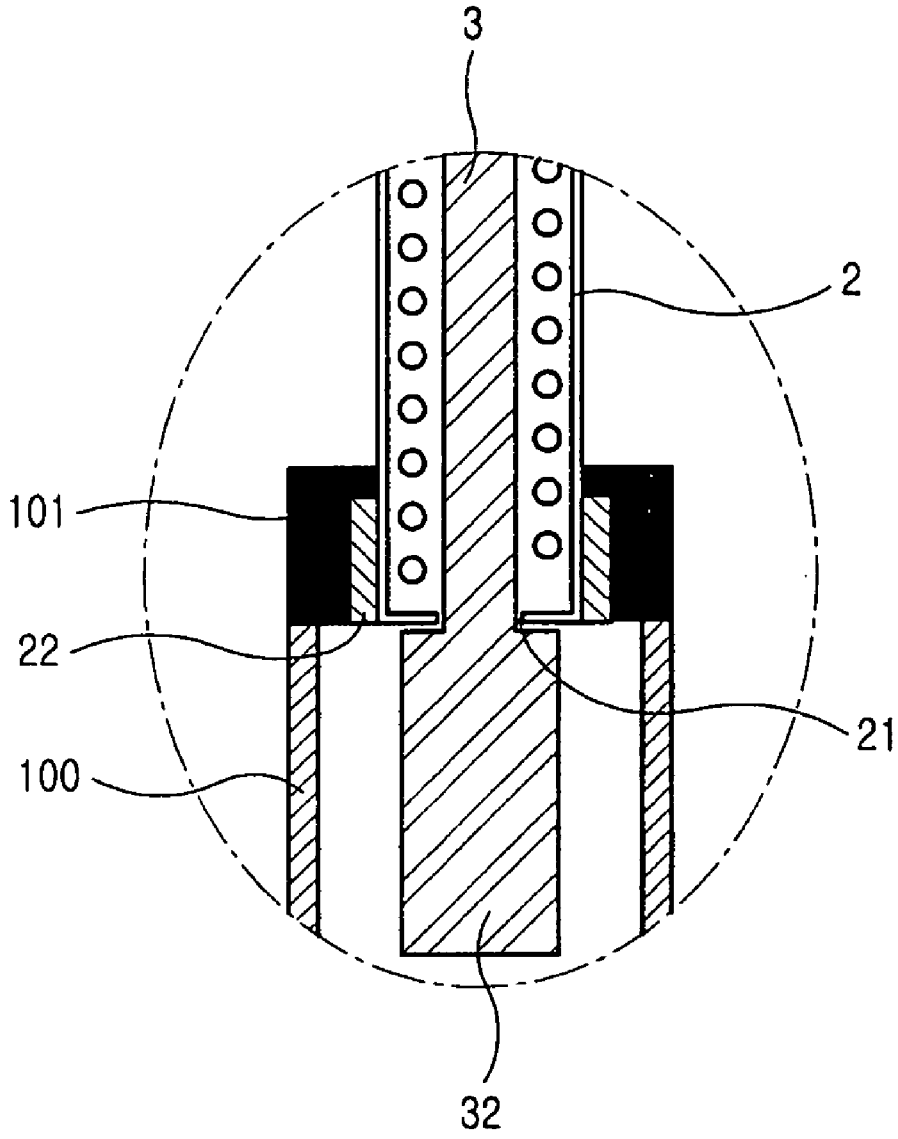
FIG. 8 is an enlarged view for part A in FIG. 7.

As shown in FIGS. 6, 7 and 8, a knob 31 is formed at one end of the whip antenna 3 in order to facilitate withdrawal of the antennas 2 and 3. At the other end of the whip antenna 3, a jaw 32 is formed in order to cause the whip antenna 3 to be engaged with a stopper portion 21 formed at the bottom of the helical antenna 2 when the whip antenna 3 is withdrawn through the helical antenna 2, as well as to permit the helical antenna to be withdrawn along an extension from the main body 1.

As shown in FIG. 5, the knob 31 takes a curved form, which is the same as the external shape of the main body 1 of the terminal. The main body 1 of the terminal has a groove 10 for mounting/demounting the knob 31.

As shown in FIG. 8, the antenna housing 100 includes a contact portion 101, which is in electric contact with a connection terminal 22 disposed in each antenna 2 and 3 when each antenna is withdrawn. The contact portion 101 is made of a metallic material. The antenna housing 100 is formed of an annular cylindrical housing made of a synthetic resin material.

Hereinafter, operation of the antenna device for a portable terminal according to a preferred embodiment of the present invention as described above will be explained in more detail with reference to FIGS. 3 to 8.

As shown in FIGS. 5 and 8, the antenna device, which is used exclusively for receiving broadcasting signals, includes the whip antenna 3, helical antenna 2 and the antenna housing 100. The antenna housing 100 is disposed at a desired position in the main body 1 of the terminal, and the whip antenna 3 and helical antenna 2 are mounted to the antenna housing 100. The antenna housing 100 is fixed to the main body 1 by means of the housing coupling portion 100 formed in the main body 1, wherein the housing coupling portion 100 supports the antenna housing 100.

Under these circumstances, as shown in FIGS. 4 and 6, when a user withdraws the knob 31 formed at one end of the whip antenna 3, the whip antenna 3 passes through the helical antenna 2, so that it can be withdrawn by a predetermined length.

Herein, as shown in FIGS. 7 and 8, the jaw 32 formed at the other end of the whip antenna 3 is engaged with the stopper portion 21 formed in the helical antenna 2 at the bottom end of the whip antenna 3, so that the helical antenna 2 is withdrawn out of the antenna housing 100.

At the same time, as shown in FIG. 4, the helical antenna 2 is withdrawn along an extension from the main body 1 of the terminal.

Further, as shown in FIG. 8, the antenna housing 100 includes the contact portion 101, which is in electric contact with the connection terminal 22 disposed in the helical antenna 2 when each of the helical antenna 2 and the whip antenna 3 is withdrawn. Therefore, the contact portion 101 formed in the antenna housing 100 is in electric contact with the connection terminal 22 simultaneously with withdrawal of the helical antenna 2 from the antenna housing 100. In this manner, broadcasting signals received by each of the helical antenna 2 and the whip antenna 3 are applied to the main body 1 of the terminal, and thus users can enjoy TV service through the main body 1 of the terminal. As shown on FIGS. 5 and 7, the helical antenna 2 is inserted into the antenna housing 100 and withdrawn therefrom.

Additionally, as shown in FIGS. 3 and 5, when the whip antenna 3 protruding out of the helical antenna 2 is inserted into the helical antenna 2, the top portion of the helical antenna 2 is in contact with the knob 31 of the whip antenna 3 at the position where the whip antenna 3 stops. Therefore, the helical antenna 2 can be inserted into the antenna housing 100, and thus be inserted into the main body 1 of the terminal.

As shown in FIG. 5, the knob 31 of the whip antenna 3 is inserted into the groove 10 formed in the main body 1 of the terminal. Because the knob 31 takes the same curved form as the external shape of the terminal, the knob 31 coincides with the external shape of the terminal as soon as it is inserted into the groove 10.

As described above, since the helical antenna as well as the whip antenna can be retracted into the terminal, the terminal has an attractive appearance and the antennas can be prevented from being damaged by external factors.

While the invention has been shown and described with reference to certain preferred embodiments thereof, it will be understood by those skilled in the art that various changes in form and details may be made therein without departing from the spirit and scope of the invention as defined by the appended claims.

What is claimed is:

1. An antenna device for a portable terminal, which includes:

a whip antenna provided in a main body of the terminal;

a helical antenna through which the whip antenna passes; and an antenna housing disposed at a desired position in the main body, which permits the whip antenna to be retracted and withdrawn, while causing the helical antenna to be withdrawn along an extension from the main body, and permits the helical antenna to be retracted, so that it can be inserted into the main body, wherein the whip antenna has a knob formed at a first end thereof and a jaw formed at a second end thereof, the jaw being engaged with a stopper portion formed at a bottom of the helical antenna when the whip antenna is withdrawn through the helical antenna, thereby causing the helical antenna to be withdrawn along an extension from the main body.

2. An antenna device for a portable terminal as claimed in claim 1, wherein when the whip antenna is withdrawn through the helical antenna by a predetermined length, the jaw of the whip antenna is engaged with the stopper portion of the helical antenna at a position where the whip antenna stops, so that the helical antenna is withdrawn out of the antenna housing, and thus is withdrawn along an extension from the main body by a predetermined length; and when the whip antenna is inserted into the helical antenna, a top portion of the helical antenna is in contact with the knob of the whip antenna at a position where the whip antenna stops, so that the helical antenna can be inserted into the antenna housing.

3. An antenna device for a portable terminal as claimed in claim 1, wherein the main body further includes a groove for mounting and demounting of the knob.

4. An antenna device for a portable terminal as claimed in claim 1, wherein the knob takes a curved shape that coincides with external shape of the terminal at the location where the antenna device penetrates the main body of the terminal.

5. An antenna device for a portable terminal as claimed in claim 4, wherein the main body further includes a groove for mounting and demounting the knob.

6. An antenna device for a portable terminal as claimed in claim 1, wherein the antenna housing includes a contact portion, which is in electric contact with a connection terminal disposed in each of the helical antenna and the whip antenna when each antenna is withdrawn.

7. An antenna device for a portable terminal as claimed in claim 6, wherein the contact portion is made of a metallic material.

8. An antenna device for a portable terminal as claimed in claim 1, wherein the antenna housing is formed of an annular cylindrical housing made of a synthetic resin material.

9. An antenna device for a portable terminal as claimed in claim 1, wherein the main body includes a housing coupling portion for supporting the antenna housing.

10. An antenna device for a portable terminal, which includes a whip antenna and helical antenna through which the whip antenna passes, wherein the whip antenna is retracted and withdrawn, while the helical antenna is withdrawn along an extension from a main body of the terminal, and the helical antenna is retracted, so that it can be inserted into the main body, wherein the whip antenna has a knob formed at a first end thereof and a jaw formed at a second end thereof, the jaw being engaged with a stopper portion formed at a bottom of the helical antenna when the whip antenna is withdrawn through the helical antenna, thereby causing the helical antenna to be withdrawn along an extension from the main body.

* * * * *